US007878726B2

(12) United States Patent
Kageyama et al.

(10) Patent No.: US 7,878,726 B2
(45) Date of Patent: Feb. 1, 2011

(54) STICK-SHAPED MATERIAL PROPELLING CONTAINER

(75) Inventors: Hidehei Kageyama, Kawagoe (JP); Tadashi Keda, Kawagoe (JP)

(73) Assignee: Kotobuki & Co., Ltd., Kawagoe, Saitama (JP)

( * ) Notice: Subject to any disclaimer, the term of this patent is extended or adjusted under 35 U.S.C. 154(b) by 560 days.

(21) Appl. No.: 11/616,462

(22) Filed: Dec. 27, 2006

(65) Prior Publication Data

US 2007/0248397 A1 Oct. 25, 2007

(30) Foreign Application Priority Data

Jan. 13, 2006 (JP) ..... 2006-006532

(51) Int. Cl.
*B43K 23/00* (2006.01)

(52) U.S. Cl. ..... 401/92; 401/88

(58) Field of Classification Search ..... 401/62, 401/65, 67, 92, 109, 88
See application file for complete search history.

(56) References Cited

U.S. PATENT DOCUMENTS 2,652,029 A * 9/1953 Metcalf ..... 15/433
5,165,813 A * 11/1992 Kageyama et al. ..... 401/65
5,362,166 A * 11/1994 Yamamoto et al. ..... 401/93
2004/0047669 A1* 3/2004 Lo ..... 401/92

FOREIGN PATENT DOCUMENTS

| | | | |
|---|---|---|---|
| CH | 209 366 | A | 4/1940 |
| CH | 209366 | | 4/1940 |
| DE | 387 264 | C | 12/1923 |
| EP | 0 280 220 | A1 | 8/1988 |
| FR | 2 664 480 | A | 1/1992 |
| FR | 2664480 | | 1/1992 |
| GB | 2 131 355 | A | 6/1984 |
| JP | 3-44552 | | 9/1991 |
| JP | 5-1426 | | 1/1993 |

OTHER PUBLICATIONS

European Search Report EP 07 10 0011; report dated May 10, 2007.

* cited by examiner

*Primary Examiner*—David J. Walczak
(74) *Attorney, Agent, or Firm*—Miller, Matthias & Hull LLP

(57) ABSTRACT

An inner barrel is slidably inserted into an outer barrel, chuck pieces which hold a stick-shaped material is provided at a tip end portion of the inner barrel, a chuck ring is inserted between the chuck pieces and the outer barrel, an elastic member receiving part is provided at part of an inner peripheral surface in a circumferential direction of the outer barrel, an elastic member receiving part is provided at part of an outer peripheral surface in the circumferential direction of the inner barrel, and a coil spring is placed at part in a circumferential direction of the outer barrel and the inner barrel between the elastic member receiving part and the elastic member receiving part, and urges the inner barrel with respect to the outer barrel.

8 Claims, 8 Drawing Sheets

STICK-SHAPED MATERIAL PROPELLING CONTAINER

BACKGROUND OF THE INVENTION

1. Field of the Invention

The present invention relates to a stick-shaped material propelling container capable of propelling and retracting a stick-shaped material such as a stick-shaped eraser, a pencil lead, crayon, pastel, and an eyebrow pencil material.

2. Description of the Related Art

As a stick-shaped material propelling container of this kind, those disclosed in Japanese Utility Model Laid-Open No. 3-44552 and Japanese Utility Model Laid-Open No. 5-1426 are conventionally known. In the stick-shaped material propelling container disclosed in each of the documents, an inner barrel is slidably inserted into an outer barrel, an elastic member which urges the inner barrel rearward is provided between the inner barrel and the outer barrel, chuck pieces which hold the stick-shaped material are provided at a tip end portion of the inner barrel, a chuck ring is inserted between the chuck pieces and the outer barrel, and sliding of the inner barrel forward and rearward allows the stick-shaped material to be propelled and retracted.

In such a conventional stick-shaped material propelling container, the elastic member which is wound around an outer periphery of the inner barrel is a coil spring, and the coil spring is inserted between a spring bearing formed on an inner peripheral surface of the outer barrel and a spring bearing formed on an outer peripheral surface of the inner barrel.

However, in the conventional stick-shaped material propelling container, because the elastic member is wound around the outer side of the outer periphery of the inner barrel, the outside diameter of the outer barrel becomes large due to the occupancy of the elastic member, and there arises the problem that the outside diameter of the stick-shaped material propelling container cannot be made thin.

Furthermore, when the outer shapes of the cross-sections of the stick-shaped material and the inner barrel are circular, an ordinary coil spring can be used as the elastic member. However, when the outer shapes of the cross-sections of the stick-shaped material and the inner barrel are not circular, the cross-sectional shape of the elastic member has to be matched with the shape of the inner barrel in order to be wound around the outer side of the outer periphery of the inner barrel. Therefore, the elastic member in a special shape is required, and thus, there arises the problem of a rise in the manufacturing cost.

SUMMARY OF THE INVENTION

The present invention is made in view of the above problems, and has an object to provide a stick-shaped material propelling container capable of being made thin in diameter and being constructed at low cost.

In order to attain the above-described object, in a stick-shaped material propelling container according to the present invention, an inner barrel is slidably inserted into an outer barrel, an elastic member which urges the inner barrel rearward is provided between the inner barrel and the outer barrel, chuck pieces which hold a stick-shaped material are provided at a tip end portion of the inner barrel, a chuck ring is inserted between the chuck pieces and the outer barrel, and sliding of the inner barrel forward and backward allows the stick-shaped material to be propelled or retracted. The elastic member is placed at part of corresponding positions in a circumferential direction of the outer barrel and the inner barrel.

According to the present invention, since the elastic member is placed at part of the corresponding positions of the outer barrel and the inner barrel, as compared with the conventional construction in which the elastic member is placed on the entire periphery of the outer side of the outer periphery of the inner barrel, the outside diameter of the stick-shaped material propelling container can be made small. Since the elastic member can be formed into the shape irrelevant to the cross-sectional shape of the inner barrel or the outer barrel, the elastic member in the shape for general purpose at low cost can be used. The degree of freedom of design of the outer barrel can be also enhanced. The number of the elastic member is not limited to one, but can be more than one.

An elastic member receiving part can be provided at part of a peripheral surface in the circumferential direction of the outer barrel, a second elastic member receiving part can be provided at part of a peripheral surface in the circumferential direction of the inner barrel, and the elastic member can be inserted between the elastic member receiving part and the second elastic member receiving part. Since the elastic member receiving part of the outer barrel and the second elastic member receiving part of the inner barrel do not have to be formed on the entire peripheries of the outer barrel and the inner barrel, as compared with the conventional construction, the outside diameter of the stick-shaped material propelling container can be made small.

An elastic member housing part can be provided in part of the peripheral surface in the circumferential direction of the outer barrel, a second elastic member housing part can be provided in part of the peripheral surface in the circumferential direction of the inner barrel, and the elastic member is placed in a space formed by the elastic member housing part and the second elastic member housing part. Since the elastic member housing part of the outer barrel and the second elastic member housing part of the inner barrel do not have to be formed on the entire peripheries of the outer barrel and the inner barrel, as compared with the conventional construction, the outside diameter of the stick-shaped material propelling container can be made small.

The elastic member can be a coil spring having an outer shape of a cross-section smaller than an outer shape of a cross-section of the stick-shaped material. Since the small coil spring can be used as the elastic member, the elastic member can be made easy to handle and low in cost, and as compared with the conventional construction, the outside diameter of the stick-shaped material propelling container can be made small.

The elastic member can be placed at a rear portion of the stick-shaped material propelling container. With this structure, an enough space can be given to an area at the front portion of the stick-shaped material propelling container, where components or the like for holding the stick-shaped material are necessary to be disposed.

A clip extending along the outside of the outer barrel can be provided at the inner barrel, and the elastic member can be placed at a position in the circumferential direction so as to the clip. With this structure, the portion occupied by the elastic member can be made inconspicuous by the clip. Even when the elastic member is not completely hidden by the outer barrel, it can be covered with the clip, and therefore, the outer appearance can be made favorable.

The present disclosure relates to subject manner contained in Japanese Patent Application No. 2006-6532, filed on Jan. 13, 2006, which is expressly incorporated herein by reference in its entirety.

DETAILED DESCRIPTION OF THE PREFERRED EMBODIMENTS

An embodiment of the present invention will now be described with reference to the drawings.

Figure 1:
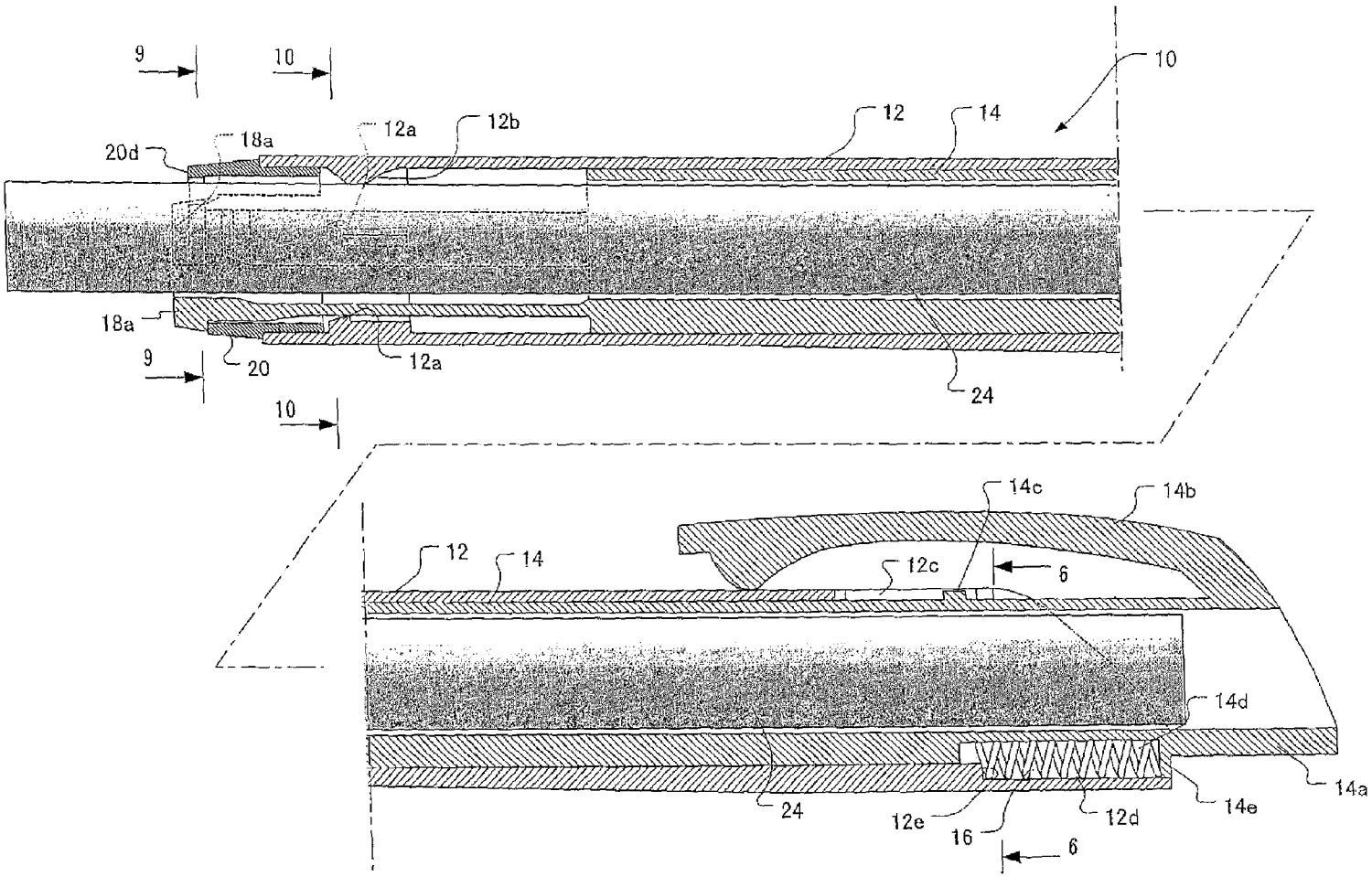
FIG. 1 is an overall longitudinal sectional view showing an embodiment of a stick-shaped material propelling container of the present invention.
Figure 2:
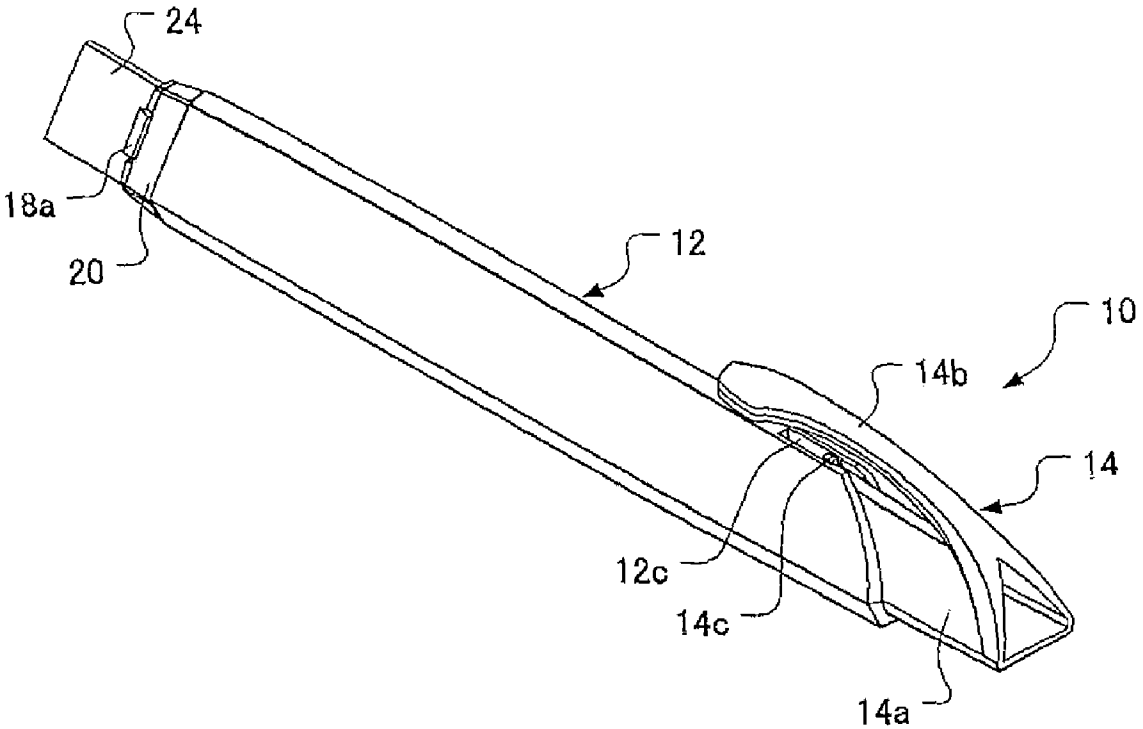
FIG. 2 is an overall perspective view of the stick-shaped material propelling container shown in FIG. 1.

FIG. 1 is an overall longitudinal sectional view showing an embodiment of a stick-shaped propelling container according to the present invention, and FIG. 2 is an overall perspective view of the stick-shaped propelling container.

A stick-shaped material propelling container 10 includes an outer barrel 12 and an inner barrel 14 which is slidably inserted in the outer barrel 12. The cross-sectional shapes of outer peripheral surfaces and inner peripheral surfaces of the outer barrel 12 and the inner barrel 14 are triangular to correspond to the cross-sectional shape of a stick-shaped material 24 which will be described later, and includes three sides which constitute a main contour. However, the cross-sectional shapes of the outer barrel 12 and the inner barrel 14 do not have to be mathematically accurate triangles, and each side may be a curve with a small curvature instead of the straight line.

As shown in FIGS. 3A to 3C and FIG. 10, on the inner peripheral surface of the front end portion of the outer barrel 12, retaining ribs 12*a* are formed at portions corresponding to the sides of the triangle of the cross-sectional shape, and a stick-shaped material fitting ribs 12*b* are formed at portions corresponding to the vertexes of the triangle of the cross-sectional shape. The respective ribs 12*a* and 12*b* are projected toward the axial center.

Figure 3A:
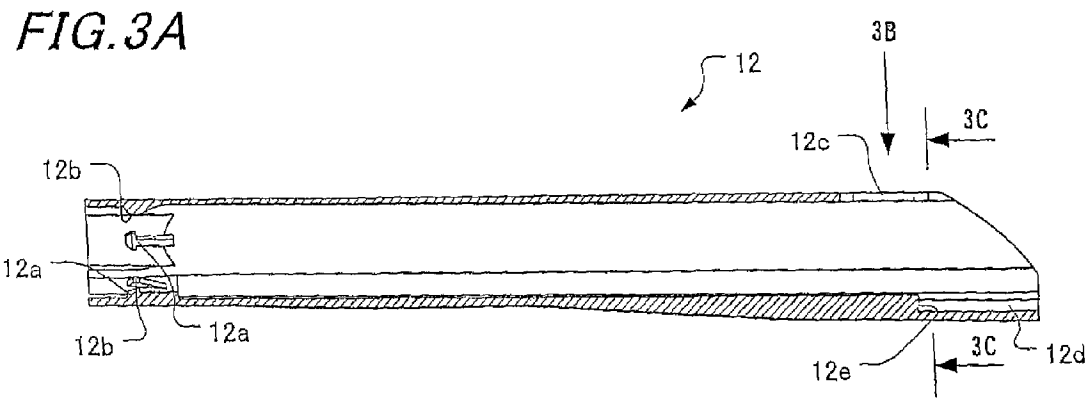
FIG. 3A is a longitudinal sectional view of an outer barrel.
Figure 3B:
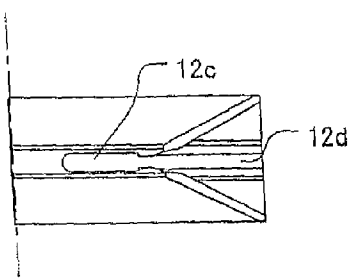
FIG. 3B is a view seen in the arrow 3B in FIG. 3A.
Figure 3C:
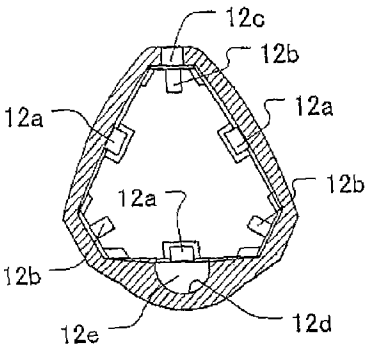
FIG. 3C is a sectional view seen along the line 3C-3C in FIG. 3A.

As shown in FIG. 3B, a slit 12*c* which extends from a rear end is formed at an upper portion of the rear end portion of the outer barrel 12, and an inlet of the rear portion of the slit 12*c* is a narrow portion. As shown in FIG. 3C, a lower portion of the rear end portion of the outer barrel 12 is thick as compared with the other portions, and a groove of a substantially semi-circular sectional shape is formed in the thick portion. This groove constitutes an elastic member housing part 12*d* for accommodating a coil spring 16 that is the elastic member which will be described later. Further, a groove wall surface located at the front end portion of the elastic member housing part 12*d* constitutes an elastic member receiving part 12*e*.

Figure 4:
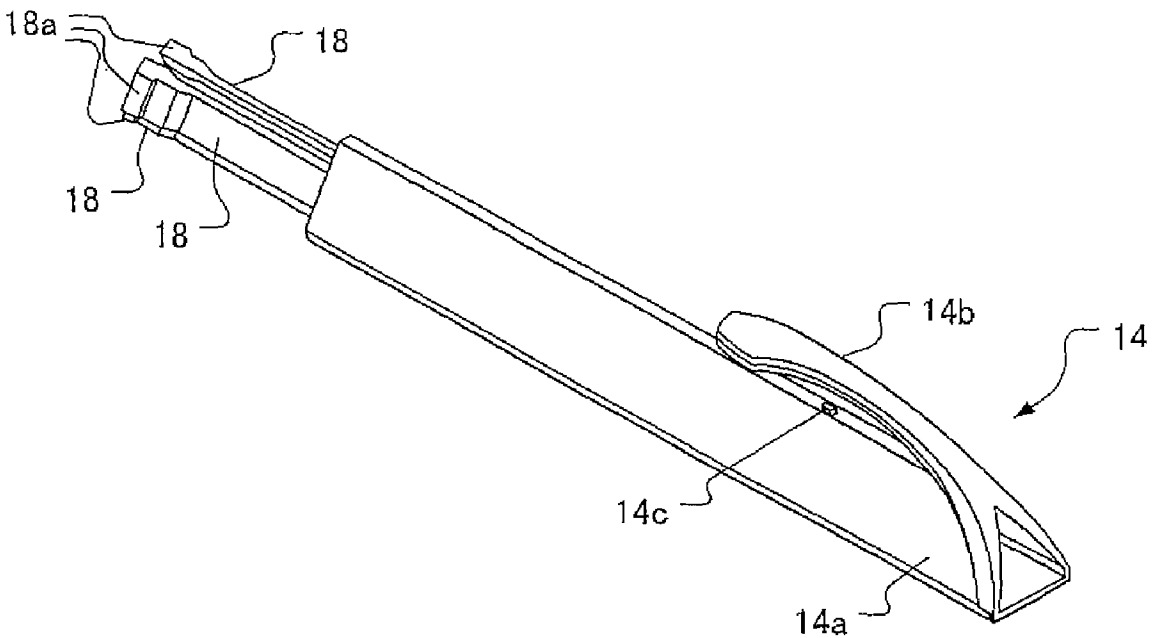
FIG. 4 is a perspective view of an inner barrel seen from the rear side.
Figure 5A:
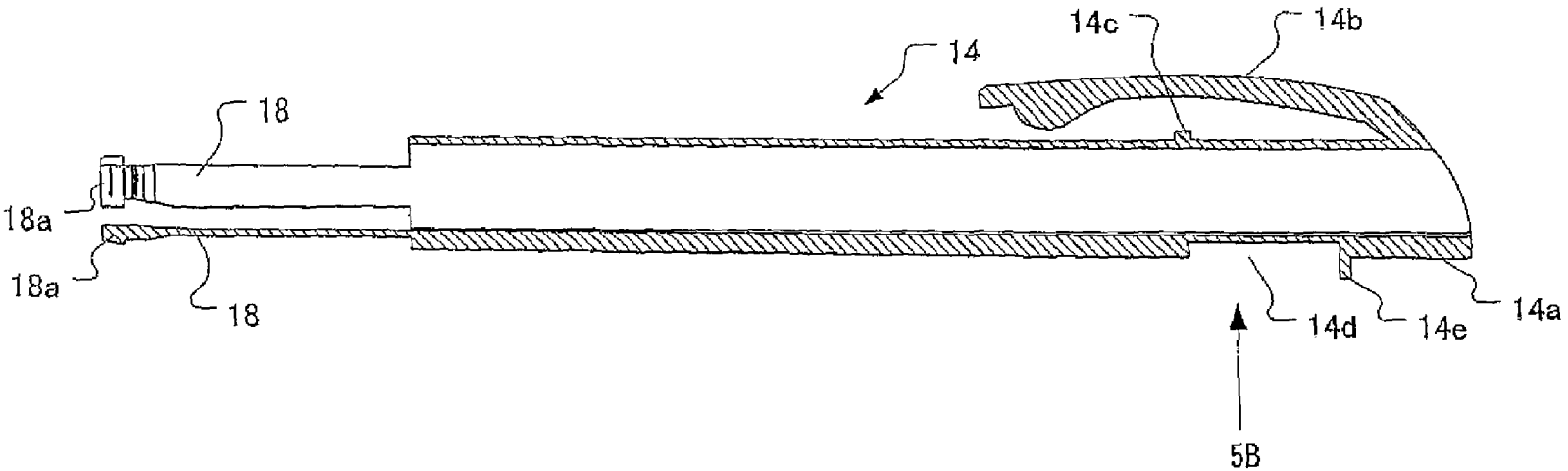
FIG. 5A is a longitudinal sectional view of the inner barrel.
Figure 5B:
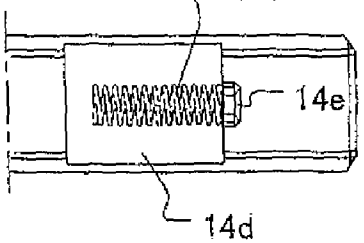
FIG. 5B is a view seen in the arrow 5B in FIG. 5A.

As shown in FIGS. 4, 5A and 5B, a projection 14*c* is formed on the peripheral surface of the upper portion of the rear portion of the inner barrel 14, and the projection 14*c* is pushed in from the narrow portion of the slit 12*c* of the outer barrel 12 and is slidably fitted into the slit 12*c*. The rear end portion of the inner barrel 14 is projected from the rear end of the outer barrel 12, the projected portion constitutes a knock part 14*a*, and a clip 14*b* is integrally formed at the knock part 14*a*. The clip 14*b* extends along the outer side of the outer barrel 12.

The lower portion of the rear portion of the inner barrel 14 is thin as compared with the other portions, and this portion constitutes an elastic member housing part 14*d* for accommodating a coil spring 16 that is the elastic member which will be described later. An elastic member receiving part 14*e* which projects in the outside direction is formed at a rear end portion of the elastic body housing part 14*d*.

Three chuck pieces 18, 18 and 18 are provided at the front end portion of the inner barrel 14, and a head part lea of each of the chucks 18 projects from the front end of the outer barrel 12. The chuck piece 18 is disposed corresponding to a central portion of the side of the cross-sectional triangle of the stick-shaped material 24 (see FIG. 10). A plurality of chuck pieces 18 are originally set to extend in the radial direction to be away from the axial center and to be away from each other.

Figure 6:
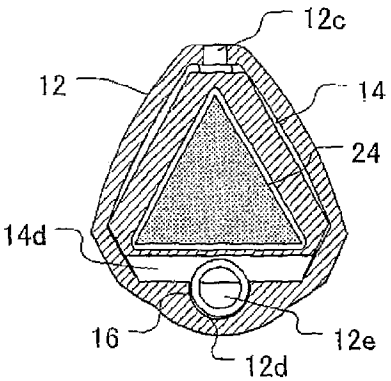
FIG. 6 is a sectional view seen along the line 6-6 in FIG. 1.

The elastic member housing part 12*d* of the outer barrel 12 and the elastic member housing part 14*d* of the inner barrel 14 are opposed to each other with their circumferential positions aligned with each other, and as shown in FIG. 6, the coil spring 16 that is the elastic member is placed in a space formed by the elastic member housing part 12*d* and the elastic member housing part 14*d*. The front end of the coil spring 16 abuts on the elastic member receiving part 12*e* of the outer barrel 12, and the rear end of the coil spring 16 abuts on the elastic member receiving part 14*e* of the inner barrel 14. Thus, the coil spring 16 is inserted between the elastic member receiving part 12*e* and the elastic member receiving part 14*e* and always urges the inner barrel 14 rearward with respect to the outer barrel 12. The coil spring 16 is a general-purpose coil spring 16 circular in its cross-sectional shape.

A chuck ring 20 is inserted between the chuck pieces 18 and the outer barrel 12. A body 20*a* of the chuck ring 20 is shaped a triangle corresponding to the cross-sectional shape of the stick-shaped material 24 with the respective cross-sectional shapes of the outer peripheral surface and the inner peripheral surface being triangles, and includes three sides constituting main sides. However, the cross-sectional shape does not have to be a mathematically accurate triangle in this case, and each side may be a curve with a small curvature instead of a straight line.

Figure 7B:
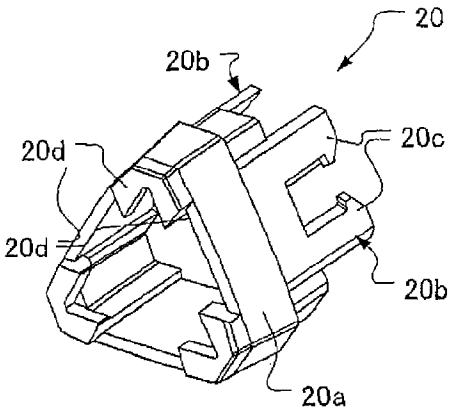
FIG. 7B is a perspective view of the chuck ring seen from the front side.
Figure 7A:
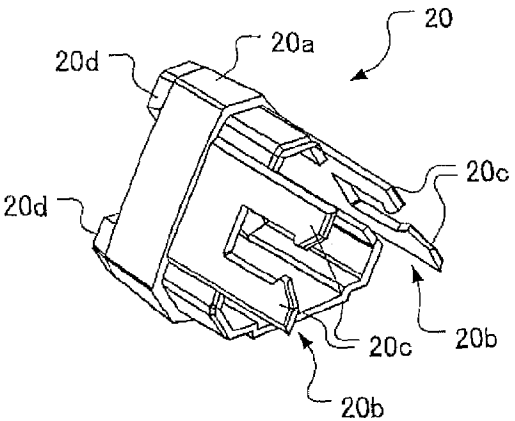
FIG. 7A is a perspective view of a chuck ring seen from the rear side.
Figure 8:
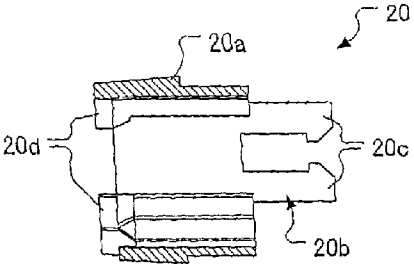
FIG. 8 is a longitudinal sectional view of the chuck ring.
Figure 9A:
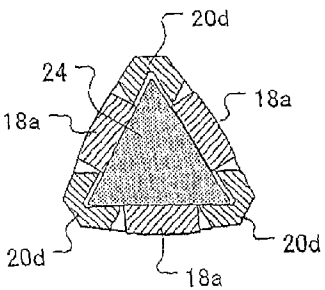
FIG. 9A is a sectional view seen along the line 9-9 in FIG. 1.
Figure 9B:
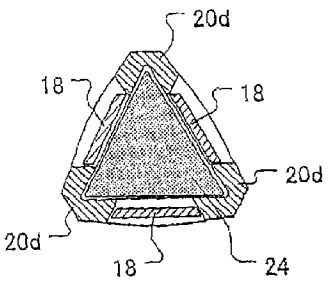
FIG. 9B is an equivalent sectional view at the time of knocking.
Figure 10:
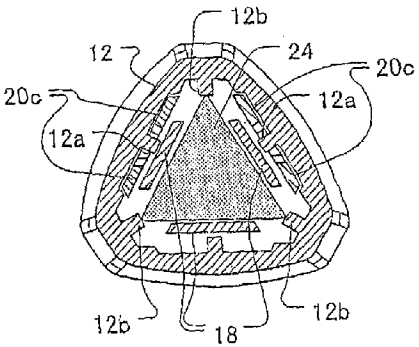
FIG. 10 is a sectional view seen along the line 10-10 in FIG. 1.

Part of the body 20*a* is disposed outside in front of the outer barrel 12, and from a rear end portion of the body 20*a*, locking parts 20*b* and 20*b* extend into the outer barrel 12. The locking parts 20*b*, 20*b* are slidable with respect to the outer barrel 12 and prevent the body 20*a* from separating from the outer barrel 12. Each of the locking parts 20*b* is constructed by a pair of hook pieces 20*c* and 20*c* which are hooked head portions opposed to each other, as shown in FIGS. 7A, 7B and FIG. 8.

The hook pieces 20*c* and 20*c* of the locking part 20*b* are slidably guided by the retaining rib 12*a* of the outer barrel 12, and when the hook pieces 20*c* and 20*c* are caught by the enlarged head portion of the retaining rib 12*a*, the chuck ring 20 is prevented from advancing further, and separating of the chuck ring 20 from the outer barrel 12 in the forward direction is prevented.

Projected corner portions 20*d*, 20*d* and 20*d* which project forward and toward the axial center are formed at the tip end portion of the body 20*a* of the chuck ring 20, and in the normal state, the head portion 18*a* of the chuck piece 18 is fitted between the adjacent projected corner portions 20*d*, so that the head portion 18*a* of the chuck piece 18 which is urged rearward by the spring 16 is prevented from displacing rearward and is prevented from extending in the radial direction away from the axial center by the body 20*a*.

The stick-shaped material 24 that is a stick-shaped eraser of a triangle rod of which cross-section is in a triangular shape is housed in the outer barrel 12 and the inner barrel 14. Therefore, a plurality of edge lines are formed on the peripheral surface of the stick-shaped material 24. Portions of the stick-shaped material 24 corresponding to the vertexes of the cross-sectional triangle are in contact with the stick-shaped material fitting rib 12*b* in the outer barrel 12 (see FIG. 10).

In the stick-shaped material propelling container 10 which is constructed as above, the head part 18*a* of the chuck piece 18 is prevented from extending in the radial direction by the chuck ring 20 in the normal state, and therefore, each of the chuck pieces 18 abuts on the central portion of the side of the cross-sectional triangle of the stick-shaped material 24, and presses the stick-shaped material 24. Namely, the chuck piece 18 abuts on the planar portion of the stick-shaped material 24, and therefore, it can reliably hold the stick-shaped material 24, and thereby, the stick-shaped material 24 is prevented from moving. Accordingly, a portion of the stick-shaped material 24 located forward of the portion fastened by the chuck piece 18 can be used by gripping the outer barrel 12.

The tip end of the stick-shaped material 24 wears and is rounded by being used, but in the peripheral surface of the stick-shaped material 24, the edge lines corresponding to the vertexes of the triangle are present, and therefore, an operation of erasing a fine portion can be performed by using the edge lines.

When the stick-shaped material 24 is desired to be further propelled, the knock part 14*a* is pushed. Thereby, the chuck piece 18 and the stick-shaped material 24 move forward, and the chuck ring 20 also moves forward simultaneously by friction with the chuck piece 18. However, the chuck ring 20 can only move until its hook pieces 20*c* abut on the head portions of the retaining ribs 12*a*, and when they abut on the head portions, the chuck ring 20 cannot move forward any more. Therefore, only the chuck pieces 18 with the stick-shaped material 24 move forward. At this time, the chuck pieces 18 pass between the projected coiner portions 20*d* of the chuck ring 20, but the size of the gap between the adjacent chuck pieces 18 becomes smaller at the rear side, and therefore, the chuck pieces 18 are forcefully extended to the original position to be away from the axial center and to be away from each other by the projected corner portion 20*d*. Thereby, the stick-shaped material 24 is released from being fastened by the chuck pieces 18. Then, when the pushing force on the knocking part 14*a* is released, the chuck pieces 18 are retracted by the urging force of the spring 16 and return to the initial position. At this time, until the chuck pieces 18 exhibit a fastening force by the chuck ring 20, the stick-shaped material 24 is held at the position where it has advanced by the frictional force by the stick-shaped material fitting ribs 12*b* of the outer barrel 12. By the series of operations, the stick-shaped material 24 is propelled by the length substantially corresponding to the length by which the locking part 20*b* of the chuck ring 20 slides with respect to the outer barrel 12.

When the propelled stick-shaped material 24 is to be retracted, it can be retracted by pushing the knock part 14*a* to release the stick-shaped material 24 from being fastened by the chuck pieces 18, and by pushing the stick-shaped material 24 to the rear side.

The spring 16 is a general-purpose coil spring which is circular in sectional shape and small in diameter, and therefore, it is easy to handle and is low in cost. The spring 16 is only placed at part of corresponding positions in the circumferential direction of the outer barrel 12 and the inner barrel 14, and therefore, the entire outside diameter of the stick-shaped material propelling container 10 can be made small.

Since the spring 16 is placed at the rear portion of the stick-shaped material propelling container 10, an enough space can be given to the area at the front portion of the stick-shaped material propelling container 10, where the components such as chuck pieces 18 and the ribs 12*a* and 12*b* are placed.

In the above description, a stick-shaped material with a regular triangular cross-sectional shape is described, but the present invention is not limited to this, and the present invention is also applicable to an ordinary stick-shaped material with a circular cross-sectional shape. Alternatively, the cross-sectional shape of the stick-shaped material can be made an arbitrary triangle, or an arbitrary polygonal which is a quadrangle or a polygonal having more sides than the quadrangle, and the shape of at least one of the outer barrel, the inner barrel and the chuck ring can be made the shape corresponding to the polygonal shape of the stick-shaped material. As a result that the number of the edge lines of the stick-shaped material 24 increases, the number of corner portions increases, and the stick-shaped material 24 can be made suitable for a more precise and finer operation. Whatever the shape of the stick-shaped material may be, it does not have an influence on the spring 16, and therefore, it can be constructed at low cost.

In the example shown in the drawings, the placement position of the spring 16 is the rear portion of the stick-shaped material propelling container 10, but the placement position of the spring 16 is not limited to this, and the spring 16 can be placed at an intermediate portion or at the front portion.

Figure 11A:
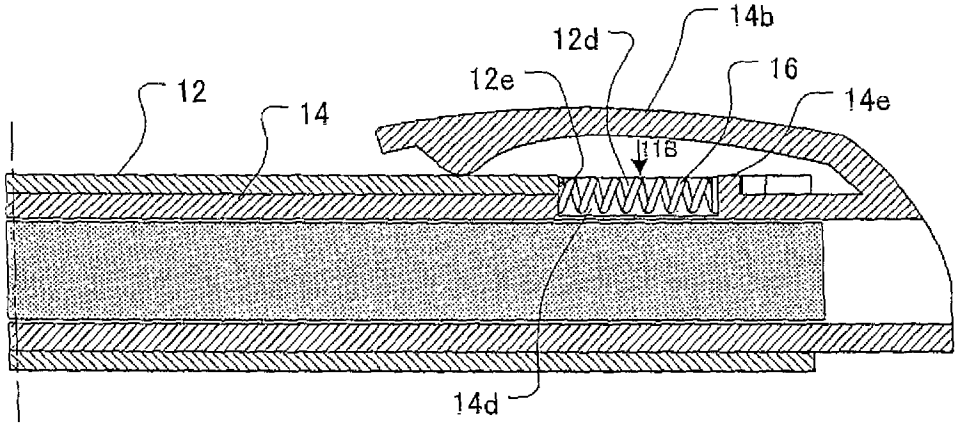
FIG. 11A is a longitudinal sectional view of the rear portion showing another embodiment of the stick-shaped material propelling container of the present invention.
Figure 11B:
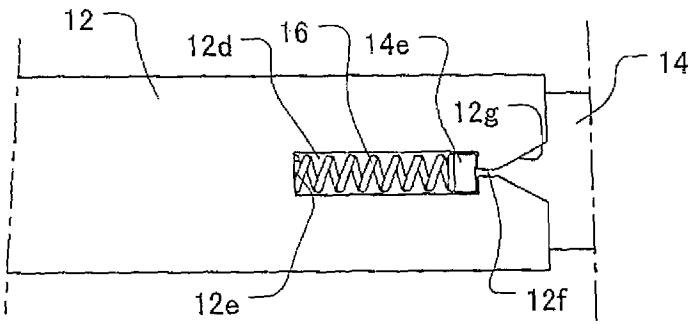
FIG. 11B is a view seen along the arrow 11B in FIG. 11A.

In the example in FIG. 1, the spring 16 is placed at the position opposite to the clip 14*b* of the inner barrel 14 in the circumferential direction, but as shown in FIGS. 11A and 11B, the spring 16 can be placed to face the clip 14*b* by making the position of the spring 16 in the circumferential direction substantially the same position as the position of the clip 14*b* of the inner barrel 14 in the circumferential direction. In this case, as shown in FIG. 11B, the elastic member housing part 12*d* of the outer barrel 12 can also be formed with the slit 12*c* of the outer barrel 12 in FIG. 1, and the elastic member receiving part 14*e* of the inner barrel 14 can also perform the same function as the projection 14*c* of the inner barrel 14 in FIG. 1. The narrow portion 12*f* which continues to the rear portion from the elastic member housing part 12*d* and is narrow in width, and the taper portion 12*g* which gradually becomes wide toward the rear end from the narrow portion 12*f* are provided in the outer barrel 12. When the inner barrel 14 is assembled into the outer barrel 12, the elastic member receiving part 14*e* is inserted from the taper portion 12*g*, passes through the narrow portion 12*f* and is forced into the elastic member housing part 12*d*. Thereby, it is difficult for the elastic member receiving part 14*e* to come out of the narrow portion 12*f* again, and the spring 16 is also held in the space formed by the elastic member housing part 12*d* and the elastic member housing part 14*d*. As shown in the drawings, when the spring 16 is not completely hidden by the outer barrel 12, it is covered with the clip 14*b*, and therefore, the outer appearance is not made poor. The thickness of the housing part by the elastic member housing part 12*d* and the elastic member housing part 14*d* can be made inconspicuous by the clip 14*b*.

In the example shown in the drawings, the number of springs 16 is one, but the number of springs is not limited to this, and a plurality of elastic member housing parts 12*d* and 14*d*, elastic member receiving parts 12*e* and 14*e* and springs can be provided to be spaced in the circumferential direction. In this case, cost increases in accordance with the number of springs 16, but general-purpose coil springs at low cost can be used, and therefore, increase in cost can be suppressed.

In the example shown in the drawings, the coil spring is used as the spring 16, but the spring 16 is not limited to this, and a general-purpose leaf spring can be used.

Further, the outer barrel 12 can be made a transparent member to make the spring 16 visible from outside positively, thus making it possible to make the spring 16 part of the design. Using of the spring 16 optionally colored can bring about change in design.

While the principles of the invention have been described above in connection with specific embodiments, and particular modifications thereof, it is to be clearly understood that this description is made only by way of example and not as a limitation on the scope of invention.

What is claimed is:

1. A stick-shaped material propelling container, comprising:

an outer barrel;

an inner barrel slidably inserted into the outer barrel and adapted to receive a stick-shaped material having sides parallel to the longitudinal axis of the stick-shaped material;

an elastic member provided between the inner barrel and the outer barrel to urge the inner barrel rearward;

chuck pieces adapted to hold the stick-shaped material provided at a tip end portion of the inner barrel; and a chuck ring inserted between the chuck pieces and the outer barrel, wherein said inner barrel includes side walls which adapt to a non-circular cross sectional contour of the stick-shaped material to surround the stick-shaped material, and one of said side walls is provided with an elastic member receiving part on the outside of one of said side walls, said non-circular cross sectional contour includes a triangle, a rectangle, or a polygon, wherein said outer barrel is provided with a second elastic member receiving part to oppose said first elastic member receiving part in an axial direction of the outer barrel, wherein the elastic member is inserted between the first elastic member receiving part and the second elastic member receiving part and is adapted to be arranged at the center of one of said sides of the stick-shaped material.

2. The stick-shaped material propelling container according to claim 1, wherein said elastic member is a coil spring having an outer shape of a cross-section smaller than an outer shape of a cross-section of the stick-shaped material.

3. The stick-shaped material propelling container according to claim 1, wherein said elastic member is placed at a rear portion of the stick-shaped material propelling container.

4. The stick-shaped material propelling container according to claim 1, wherein a clip extending along an outside of the outer barrel is provided on said inner barrel, and said elastic member is positioned on the opposite side of the axial center of the container from the clip.

5. A stick-shaped material propelling container, comprising:

an outer barrel;

an inner barrel slidably inserted into the outer barrel and adapted to receive a stick-shaped material having sides parallel to the longitudinal axis of the stick-shaped material;

an elastic member provided between the inner barrel and the outer barrel to urge the inner barrel rearward;

chuck pieces adapted to hold the stick-shaped material provided at a tip end portion of the inner barrel; and a chuck ring inserted between the chuck pieces and the outer barrel, wherein said inner barrel includes side walls which adapt to a non-circular cross sectional contour of the stick-shaped material to surround the stick-shaped material, and one of said side walls has a thin wall portion to define a first elastic member housing part outside of one of said side walls, said non-circular cross sectional contour includes a triangle, a rectangle, or a polygon, wherein said outer barrel is provided with a second elastic member housing part to oppose said first elastic member housing part, wherein the elastic member is placed in a space formed by the first elastic member housing part and the second elastic member housing part and is adapted to be arranged at the center of one of said sides of the stick-shaped material.

6. The stick-shaped material propelling container according to claim 5, wherein said elastic member is a coil spring having an outer shape of a cross-section smaller than an outer shape of a cross-section of the stick-shaped material.

7. The stick-shaped material propelling container according to claim 5, wherein said elastic member is placed at a rear portion of the stick-shaped material propelling container.

8. The stick-shaped material propelling container according to claim 5, wherein a clip extending along an outside of the outer barrel is provided on said inner barrel, and said elastic member is positioned on the opposite side of the axial center of the container from the clip.

* * * * *